US008117678B2

(12) United States Patent
Moreau et al.

(10) Patent No.: US 8,117,678 B2
(45) Date of Patent: Feb. 21, 2012

(54) HARD HAT LANYARD

(76) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 951 days.

(21) Appl. No.: 12/035,496

(22) Filed: Feb. 22, 2008

(65) Prior Publication Data

US 2008/0134416 A1 Jun. 12, 2008

Related U.S. Application Data

(63) Continuation-in-part of application No. 10/906,417, filed on Feb. 18, 2005, now abandoned.

(60) Provisional application No. 60/545,220, filed on Feb. 18, 2004.

(51) Int. Cl.
*A42B 1/24* (2006.01)

(52) U.S. Cl. ..... 2/422; 2/410

(58) Field of Classification Search ..... 2/421–422, 2/209.13, 6.2

See application file for complete search history.

(56) References Cited

U.S. PATENT DOCUMENTS 3,671,974 A * 6/1972 Sims ..... 2/421
5,272,770 A * 12/1993 Allen et al. ..... 2/421
6,648,101 B2 * 11/2003 Kurtgis ..... 182/3
6,751,809 B1 * 6/2004 Cooper et al. ..... 2/421
6,813,782 B2 * 11/2004 Kintzi et al. ..... 2/421
6,871,360 B1 * 3/2005 Ashline ..... 2/468
6,886,186 B2 * 5/2005 Jansen ..... 2/422
2004/0055077 A1 * 3/2004 Wright ..... 2/421
2004/0068779 A1 * 4/2004 Duffy ..... 2/422
2004/0073987 A1 * 4/2004 Jansen ..... 2/422
2005/0177928 A1 * 8/2005 Moreau et al. ..... 2/421
2007/0089219 A1 * 4/2007 Trainor et al. ..... 2/421

* cited by examiner

*Primary Examiner* — Shaun R Hurley
*Assistant Examiner* — Andrew Sutton
(74) *Attorney, Agent, or Firm* — Robert R. Deleault, Esq.; Mesmer & Deleault, PLLC

(57) ABSTRACT

In combination, a hard hat lanyard and a hard hat includes a lower strap having a first end and a second end, a lower strap fastening mechanism fastened to the lower strap second end where the fastening mechanism is adapted to fasten the lower strap second end to an article of clothing, an upper strap having a first end and a second end, an intermediate release mechanism fastened to the lower strap first end and the upper strap second end that is adapted to releasably secure the lower strap to the upper strap, and an upper strap fastening mechanism where the lower strap, the lower strap fastening mechanism, the upper strap, the intermediate release mechanism, and the upper strap fastening mechanism form the hard hat lanyard that attaches to the hard hat where the upper strap is fastened around a non-separating portion of the hard hat without modifying the hard hat.

18 Claims, 2 Drawing Sheets

HARD HAT LANYARD

This application is a continuation-in-part of application Ser. No. 10/906,417 filed on Feb. 18, 2005 now abandoned, which was a nonprovisional application of Application Ser. No. 60/545,220 filed on Feb. 18, 2004.

BACKGROUND OF THE INVENTION

1. Field of the Invention

The present invention relates generally to apparel worn for personal protection, namely hard hats.

2. Description of the Prior Art

Hard hats are a mandatory safety item used in or around electrical power plants, chemical plants, construction sites, warehouses, and other industrial sites. The requirements are mandated through safety programs due to overhead hazards associated in these types of industries. Hard hats are intended to be a type of safety equipment that will protect the wearer from overhead hazards as well as from bumping one's head in areas where there are low clearances. However there are cases when the hard hat can be considered a hazard in itself. For instance, in most industrial work places where overhead work is being performed, workers are typically wearing a hard hat. If a worker leans over or bumps their head the hard hat most likely will fall off. This is fine except for where the hard hat can becomes a falling object and a hazard to personnel or vital plant equipment below.

In other cases, such as at nuclear power plants, workers often will work from a bridge crane that straddles the reactor vessel cavity that is filled with water. If the hard hat falls off the worker, it may land in the pool of water. If the hard hat cannot be retrieved before it sinks the retrieval process may be time consuming and very costly. Typically, a nuclear power plant will lose approximately $100,000 per hour of down time during a refueling or maintenance outage. Depending on where the hat finally came to rest, it could take up to several hours to retrieve, and consequently could delay the plant from coming back online.

A chin strap used with a hard hat is one method to keep the hard hat on a wearer's head. However this method can be uncomfortable and sometimes a bit cumbersome. Another issue is that the chin strap is in direct contact with exposed skin. When working in contaminated environments, items that are in direct contact with exposed skin should be laundered prior to donning. However, hard hats, even with chin straps, are not typically laundered. Therefore, if the hard hat is used in a harsh or contaminated environment, it can spread to the wearer's exposed skin.

U.S. Pat. No. 701,639 (1902, Stamm) discloses a hat guard device that prevents a straw hat from blowing away. One end of the retainer is hooked through the hat, and the other end is hooked into the lapel button hole. This system may have been acceptable for straw hats. However, one cannot insert a hook into a hard hat because the hard hat material is too hard by its very nature. Also, the weight of the hard hat would pull through a lapel button hole. Furthermore, industrial workers are unlikely to wear formal jackets having lapel button holes.

U.S. Pat. No. 4,991,236 (1991, Pritchett) discloses a hat retaining device that attaches at one end to a hat and at the other end around the wearer's neck. This would be unsuitable for use with a hard hat because of the danger of attaching a loop around the wearer's neck when working in an industrial environment.

U.S. Pat. No. 6,154,887 (2000, Yagi) discloses a hat and retaining device having a permanent stopper affixed to the crown of the hat on one end and a clip on the other. This would also be unsuitable for use with a hard hat because it would require modifying standard safety equipment made to a particular standard. Adding devices to the crown of a hard hat may make it unsafe in an accident. None of the above references employ a feature that can easily release the hat from the wearer without completely removing the retaining device.

What is needed, therefore, is a device that prevents a hard hat from falling to a place where it cannot be easily retrieved. What is also needed is a hard hat retaining device that does not require modifying a piece of safety equipment. What is needed is also device that prevents contamination of the wearer by not coming into direct contact with a wearer's skin. What is further needed is a hard hat device that can be easily released when the hard hat is not being used.

SUMMARY OF THE INVENTION

It is an object of the present invention to provide a device that prevents a hard hat from falling to a place where it cannot be easily retrieved. It is also an object of the present invention to provide a hard hat retaining device that does not require modifying a piece of safety equipment. It is a further object of the present invention to provide a device that prevents contamination of the wearer by not coming into direct contact with the wearer's skin. It is yet another object of the present invention to provide a hard hat device that can be easily released when the hard hat is not being used.

The present invention achieves these and other objectives by providing a hard hat lanyard having a lower strap having a first end and a second end, a lower strap fastening mechanism adapted to fasten the lower strap second end to an article of a wearer's clothing, an upper strap having a first end and a second end, an intermediate release mechanism fastened to the lower strap first end and the upper strap second end that is adapted to releasably secure the lower strap to the upper strap, and an upper strap fastening mechanism adapted to fasten the upper strap first end to a non-separable portion of a hard hat.

The intermediate release mechanism is preferably a side release buckle but may be any type of release mechanism known to those of ordinary skill in the art that can be used to repeatedly join and release two straps to each other. The upper and lower straps are preferably made of a stretchable fabric but may be any type of flexible and/or resilient material used for tethering two items together. The upper strap fastening mechanism is preferably includes a cam buckle that is used to secure a portion of the strap that is wrapped around the hard hat inner brim. It should be noted, however, that the upper strap fastening mechanism may be removably attached to the hard hat or permanently fixed to a portion of the hard hat. The lower strap second end that attaches to the clothing of wearer may be removably attached or permanently attached to the wearer's clothing. Any of the known methods of removable and permanent attachment mechanisms may be used.

These and other features, aspects, and advantages of the present invention will become better understood with regard to the following description, claims, and accompanying drawings.

DETAILED DESCRIPTION OF THE PREFERRED EMBODIMENT

The invention is a hard hat lanyard for securing a hard hat to a wearer, the lanyard comprising a lower strap having a first end and a second end, a lower strap fastening mechanism adapted to fasten the lower strap second end to an article of a wearer's clothing, an upper strap having a first end and a second end, an intermediate release mechanism fastened to the lower strap first end and the upper strap second end that is adapted to releasably secure the lower strap to the upper strap, and an upper strap fastening mechanism adapted to fasten the upper strap first end to a hard hat.

Figure 1:
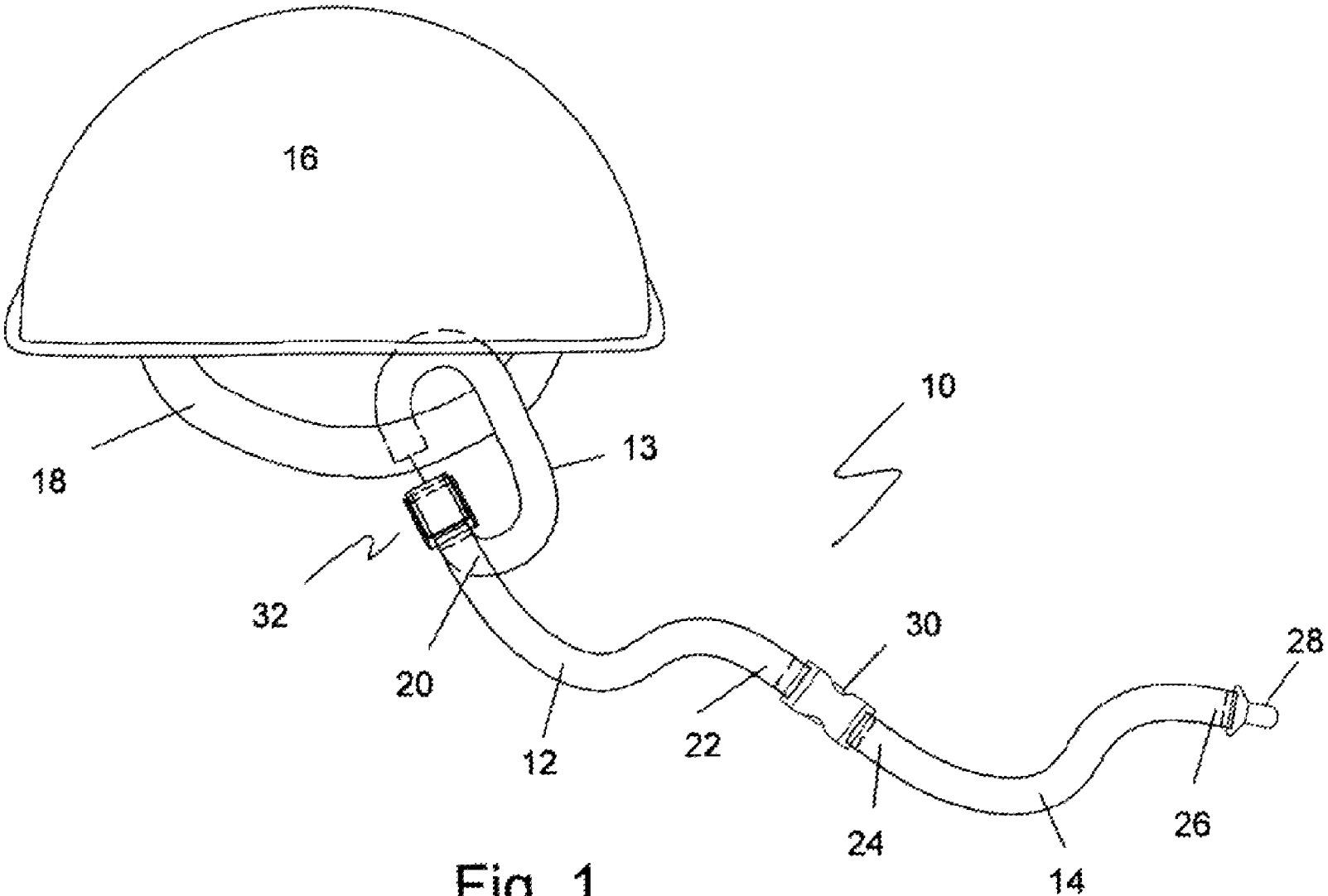
FIG. 1 is a plan view of the hard hat lanyard of the present invention.
Figure 2:
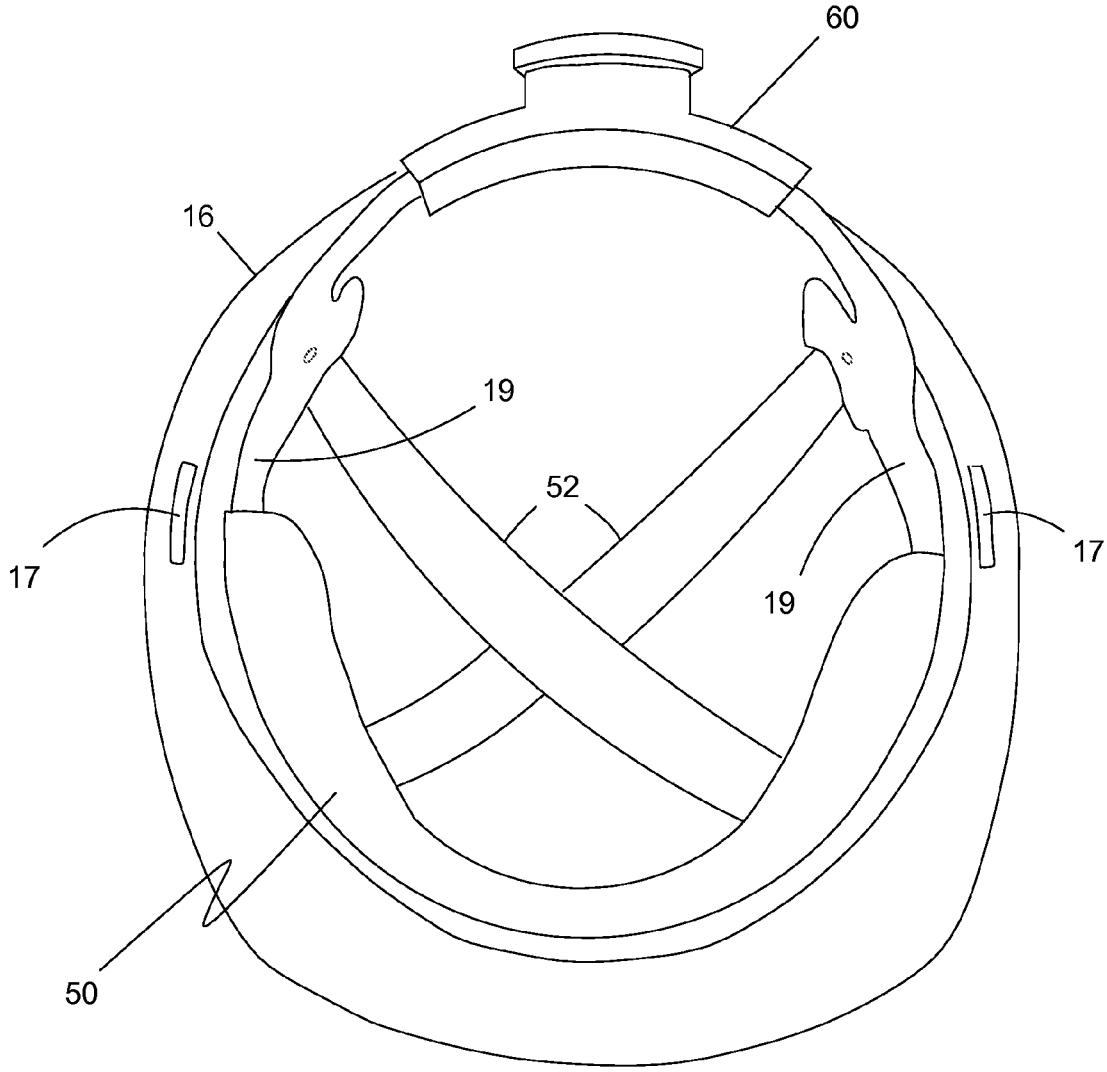
FIG. 2 is a bottom plan view of the inside of a hard hat.

The preferred embodiment(s) of the present invention is illustrated in FIGS. 1-2. Turning now to FIG. 1, the hard hat lanyard 10 includes an upper strap 12 and a lower strap 14. The straps are preferably made of a stretchable fabric. The stretchable fabric is a polyester elastic webbing, such as that made by American Cord and Webbing. Use of a stretchable fabric helps dampen, or soften, the initial shock of the hard hat when it has fallen from the wearer's head. Although a non-stretchable fabric can be used, the trauma to all the components of the hard hat lanyard, clothing attached to the hard hat lanyard, and the hard hat itself would be much greater when the hard hat falls from the wearer's head. This could accelerate wearing, or even tearing of components of the hard hat lanyard, as well as the clothing or hard hat attached to the hard hat lanyard.

The lower strap 14 has a first end 24 and a second end 26 opposite the first end. A lower strap fastening mechanism 28 is fastened to the lower strap second end. The lower strap fastening mechanism 28 is adapted to fasten the lanyard 10 by the lower strap second end 26 to an article of a wearer's clothing, such as a shirt, jacket, or overalls. The lower strap fastening mechanism 26 could be any of a suspender clip, garter clip, button snap, or the lower strap second end could even be secured to clothing by sewn stitches, adhesive and the like.

For industries where protective clothing is used it may be helpful to eliminate the lower strap fastening mechanism 26, and stitch the stretchable fabric directly to the protective clothing itself. This could be particularly handy in those cases where a uniform such as coveralls or other protective clothing is worn on a daily basis. In this embodiment, one portion of the hard hat lanyard will remain on the clothing at all times.

The upper strap 12 has a first end 20 and a second end 22 opposite the first end. Cooperating ends of an intermediate release mechanism 30 are fastened to the upper strap second end 22 and the lower strap first end 24. The intermediate release mechanism is adapted to releasably secure the lower strap 14 to the upper strap 12. Preferably, the intermediate release mechanism 30 is a side release buckle.

The intermediate release mechanism enables the hard hat lanyard 10 to separate into two pieces. This allows the wearer to remove the hard hat 16 from the head without the entire hard hat lanyard 10 still being attached to the clothing. This becomes particularly convenient when the wearer is taking a break from work, or is even done work for the day. When the wearer puts the hard hat 16 back on the head, it is then an easy process to reattach the intermediate release mechanism 30, thus making the hard hat lanyard 10 one piece again.

To the upper strap first end 20 is secured an upper strap fastening mechanism 32 that may optionally include an inner brim securing strap 13 that wraps around a hard hat inner brim 18. Upper strap fastening mechanism 32 is adapted to fasten the upper strap first end 20 to a hard hat 16. When the optional inner brim securing strap 13 is used, one end of inner brim securing strap 13 couples to upper strap fastening mechanism 32. The upper strap fastening mechanism 32 is preferably selected from the group consisting of a slip through cam buckle or a hook and loop fastener. When optional inner brim securing strap 13 is not used, upper strap fastening mechanism 32 may be one of a button snap adapted to fasten to a mating snap on hard hat inner brim 18, a button snap adapted to fasten to a mating snap on the hard hat shell, or may be permanently fastened to either hard hat inner brim 18 or to hard hat 16. The upper strap fastening mechanism 32 may also be configured to allow a wearer to make minor adjustments to the length of the hard hat lanyard 10.

It is important to note that the types of fastening mechanisms described such as clips, buckles, fasteners, and the like, is not limiting and that any type of fastening mechanism (both releasable and permanent or combinations thereof) may be used with the present invention.

Turning now to FIG. 2, there is illustrated one embodiment of the inside of a hard hat 16. Hard hat 16 has head support structure 50 connected to hard hat 16 such that head support structure 50 supports hard hat 16 above the head of a user. Heat support structure 50 includes a hard hat inner brim 18, a head support 52 securely attached to inner brim 18, and an adjustable head band portion 60, Adjustable head band portion 60 provides means for adjusting the fit of the inner brim 18 to a user's head. Hard hat 16 also includes at least a pair of strap openings 17 for receiving chin straps and the like.

It is an important aspect of the present invention that the hard hat lanyard 10 attach to a portion of the hard hat or hard hat opening that cannot be separated. For instance, hard hat lanyard 10 must be connected to one of the pair of strap openings 17 or to a non-separating portion 19 of inner brim 18 or to the head support 52 since head support 52 is also securely connected to the non-separable portion 19 inner brim 18.

Because hard hats have more mass than baseball caps and the like, hard hat lanyard 10 should not be connected to a separable portion 60 (also known as the adjustment band portion) of inner brim 18. In the unfortunate event that the hard hat falls off of one's heat, the hard hat lanyard functions to prevent the hard hat 16 from falling away from the user and potentially causing injury to a person below, damage to expensive equipment, contamination to a process, and/or any number of unfortunate side effects caused by the falling hard hat 16. If the hard hat lanyard 10, however, is connected to a separable portion of hard hat 16 such as the adjustment band portion 60, the stress imparted on the adjustment band portion 60 caused by the hard hat lanyard 10 stopping the fall of the hard hat 16 may, at times, cause the adjustment band portion 60 to separate and detach from the hard hat lanyard 10. This would defeat the purpose of the hard hat lanyard 10.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. In combination, a hard hat lanyard and a hard hat for preventing a hard hat from falling away from a wearer comprising:

a lower strap having a first end and a second end;

a lower strap fastening mechanism fastened to the lower strap second end wherein the fastening mechanism is adapted to fasten the lower strap second end to an article of a wearer's clothing;

an upper strap having a first end and a second end;

an intermediate release mechanism fastened to the lower strap first end and the upper strap second end that is adapted to releasably secure the lower strap to the upper strap; and an upper strap fastening mechanism wherein the lower strap, the lower strap fastening mechanism, the upper strap, the intermediate release mechanism, and the upper strap fastening mechanism form the hard hat lanyard having a single point of attachment at each end that attaches on one end to the hard hat wherein the upper strap is fastened around a non-separating opening in the hard hat without modification of the hard hat so as to prevent separation and detachment of the hard hat lanyard from the hard hat caused by stress imparted onto the hard hat by the hard hat lanyard when stopping a fall of the hard hat when the hard hat is inadvertently removed from a wearer's head.

2. The combination of claim 1, wherein the lower strap fastening mechanism is selected from the group consisting of a suspender clip, a garter clip, a button snap, sewn stitches, and adhesive.

3. The combination of claim 1, wherein the intermediate release mechanism is a side release buckle.

4. The combination of claim 1, wherein the upper strap fastening mechanism is selected from the group consisting of a slip through cam buckle, a hook and loop fastener, and a button snap.

5. The combination of claim 1, wherein the upper strap is made of a stretchable fabric capable of dampening the shock loading of a hard hat falling off of a wearer.

6. The combination of claim 5, wherein the stretchable fabric is polyester elastic webbing.

7. The combination of claim 1, wherein the lower strap is made of a stretchable fabric capable of dampening the shock loading of a hard hat falling off of a wearer.

8. The combination of claim 7, wherein the stretchable fabric is polyester elastic webbing.

9. A hard hat lanyard and a hard hat combination for preventing a hard hat from falling away from a wearer comprising:

a hard hat having an inner brim with a non-separating portion;

a lower strap having a first end and a second end;

a lower strap fastening mechanism fastened to the lower strap second end and adapted to fasten the lower strap second end to an article of a wearer's clothing;

an upper strap having a first end and a second end;

an intermediate release mechanism fastened to the lower strap first end and the upper strap second end that is adapted to releasably secure the lower strap to the upper strap; and an upper strap fastening mechanism wherein the lower strap, the lower strap fastening mechanism, the upper strap, the intermediate release mechanism, and the upper strap fastening mechanism form the hard hat lanyard having a single point of attachment at each end that attaches on one end to the hard hat wherein the upper strap is fastened around a non-separating opening in the hard hat without modifying the hard hat so as to prevent separation and detachment of the hard hat lanyard from the hard hat caused by stress imparted onto the hard hat by the hard hat lanyard when stopping a fall of the hard hat when the hard hat is inadvertently removed from a wearer's head.

10. The combination of claim 9, wherein the lower strap fastening mechanism is one selected from the group consisting of a suspender clip, a garter clip, a button snap, sewn stitches, and adhesive.

11. The combination of claim 9, wherein the intermediate release mechanism is a side release buckle.

12. The combination of claim 9, wherein the upper strap fastening mechanism is one selected from the group consisting of a slip through cam buckle, a hook and loop fastener, and a button snap.

13. The combination of claim 9, wherein the upper strap is made of a stretchable fabric capable of dampening the shock loading of a hard hat falling off of a wearer.

14. The combination of claim 13, wherein the stretchable fabric is polyester elastic webbing.

15. The combination of claim 9, wherein the lower strap is made of a stretchable fabric capable of dampening the shock loading of a hard hat falling off of a wearer.

16. The combination of claim 15, wherein the stretchable fabric is polyester elastic webbing.

17. A method of preventing a hard hat from falling away from a wearer, the method comprising the steps of:

providing a hard hat lanyard having a single point of attachment at each end comprising:

a lower strap having a first end and a second end;

an upper strap having a first end and a second end;

a lower strap fastening mechanism adapted to fasten the lower strap second end to an article of a wearer's clothing;

an intermediate releasing mechanism adapted to releasably secure the lower strap to the upper strap; and an upper strap fastening mechanism; and fastening the upper strap fastening mechanism around a non-separating opening in the hard hat without modifying the hard hat so as to prevent separation and detachment of the hard hat lanyard from the hard hat caused by stress imparted onto the hard hat by the hard hat lanyard when stopping a fall of the hard hat when the hard hat is inadvertently removed from a wearer's head.

18. The method of claim 17 wherein the fastening step further includes loosely looping the upper strap around the non-separating portion of the inner brim and attaching the upper strap first end to the upper strap fastening mechanism.

* * * * *